United States Patent [19]

Spears

[11] 3,961,727

[45] June 8, 1976

[54] COLLAPSIBLE TUBE SQUEEZING DEVICE

[76] Inventor: Cecil Julius Spears, 112 McFarland Road, Enfield, N.C. 27823

[22] Filed: Nov. 4, 1975

[21] Appl. No.: 628,781

[52] U.S. Cl. ..... 222/103
[51] Int. Cl.[2] ..... B65D 35/28
[58] Field of Search ..... 222/103, 101, 102, 95, 222/96, 97

[56] References Cited

FOREIGN PATENTS OR APPLICATIONS 261,248 8/1949 Switzerland ..... 222/103

*Primary Examiner*—Stanley H. Tollberg
*Attorney, Agent, or Firm*—Harold L. Stowell

[57] ABSTRACT

Collapsible tube squeezing device consists of a pair of jaw members defining therebetween a collapsible tube receiving zone, a first pair of links pivotally connecting opposite side of one end of each jaw member with the longitudinal axes of the pair of links being generally normal to planes of the jaw members and a second pair of links pivotally connected at one end to the pivotal connection between the first pair of links and one of the jaw members and connected at the other end to the other jaw member for limited sliding motion in a plane parallel to the planes of the jaw members.

6 Claims, 7 Drawing Figures

COLLAPSIBLE TUBE SQUEEZING DEVICE

CROSS-REFERENCE TO RELATED APPLICATIONS

Related subject matter is disclosed and claimed in my co-pending application, Ser. No. 500,444 filed Aug. 26, 1974.

BACKGROUND OF THE INVENTION

Collapsible tube squeezing devices for dispensing the contents of tubes containing toothpaste, hair creme, hand lotion, shoe polishing creme, glue, and the like are well known in the art. A review of the prior art devices shows that while such devices exist they have not received substantial user acceptance due to their expense, size, lack of universality, difficulties with operation and the necessity to use both of the operator's hands in emptying the contents of collapsible tubes.

The advent of collapsible tubes formed of plastic, rather than the well known metallic type collapsible tubes, has also presented additional problems which have rendered many pre-plastic tube squeezing devices unsuitable for their intended purposes particularly in regard to removal of the contents of the crown portion of such tubes. Crown portions of plastic collapsible tubes have a tendency to be substantially more rigid than crowns of metallic tubes.

It is a particular object of the present invention to provide a collapsible tube squeezing device which will accommodate a large variety of sizes of collapsible tubes in a relatively inexpensive, simple to operate, collapsible tube squeezing device which is particularly adapted to remove the contents of both metallic and plastic forms of tubes.

Another object of the present invention is to provide such a device which is relatively compact in size and may be operated with one hand and with the base of the device aligned in substantially any plane, that is, the provision of a tube squeezing device which is not direction sensitive.

It is a further objection of the present invention to provide such a device which may be cast, molded, stamped or formed from plastic, wood, metal or combinations thereof or any suitable material.

In general the present invention comprises a collapsible tube squeezing device comprising a pair of jaw members, means mounting said jaw members to receive a collapsible tube therebetween, said mounting means including:

a. A first pair of links pivotally connecting opposite side of one end of each jaw member with the longitudinal axes of the pair of link being generally normal to planes of the jaw members, and b. A second pair of links pivotally connected at one end to the pivotal connection between the first pair of links and one of the jaw members and connected at the other end to the other jaw member for limited sliding motion in a plane parallel to the planes of the jaw member.

The invention may also include novel tube holding or tube holding and feeding means associated with said pair of jaw members.

BRIEF DESCRIPTION OF THE DRAWINGS

The invention will be more particularly described in reference to the accompanying drawing wherein:

Referring now to FIGS. 1–4, 10 generally designates a form of the improved tube squeezing device and includes a first jaw member 12 and a second jaw member 14. The pair of jaw members 12 and 14 are pivotally connected adjacent the rearward end 16 thereof by two pairs of links with a pair on each side of the jaw members.

Figure 1:
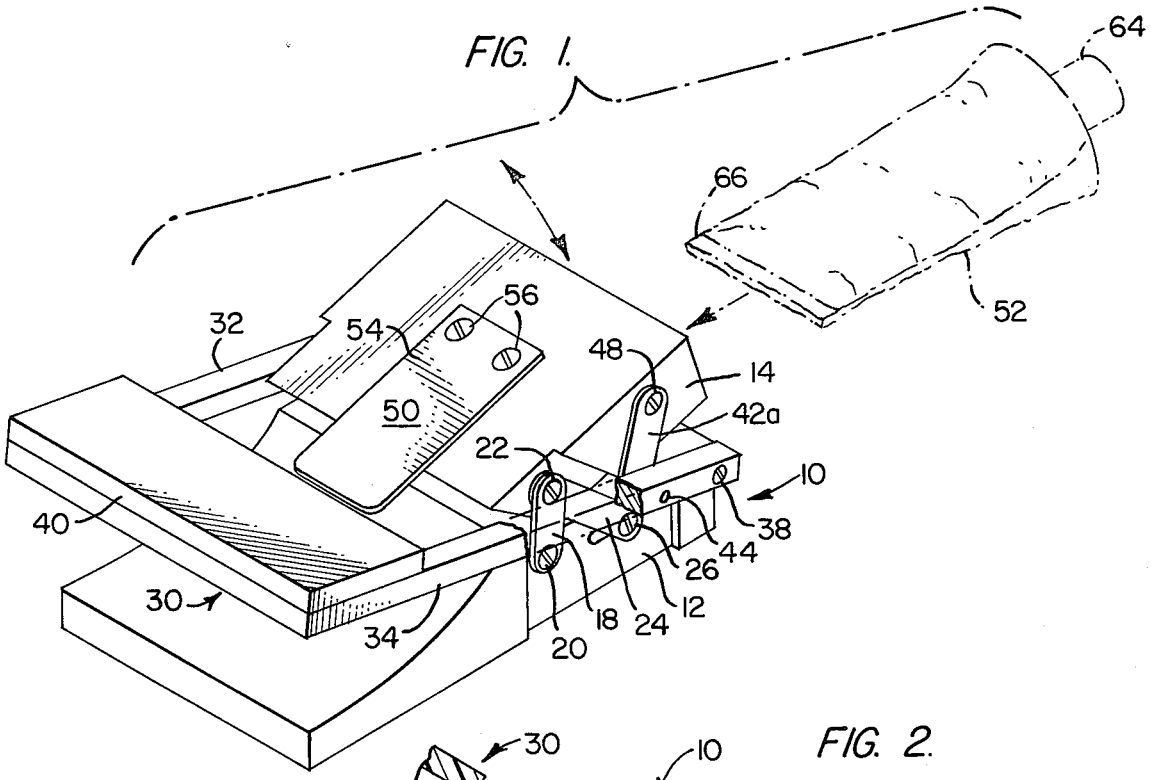
FIG. 1 is a perspective view of one form of collapsible tube squeezing device of the present invention.

The pairs of links comprise a first link 18 which is pivoted via pivot pin or screw 20 to the lower jaw member 12 and via pivot pin or screw 22 to the upper jaw member 14. The other link of each pair of links designated 24 is pivotally connected to the upper jaw member 14 by the pivot pin 22 which as previously described also connects the first link 18 of the pair of links to the upper jaw member 14. The other end of the link 24 is pivotally connected to the jaw member 12 by a pin 26 which pin engates an elongated slot 28 in the jaw member 12 whereby the link 24 has limited sliding movement relative the jaw 12.

A convenient method of attaching the two pair of links 18 and 24 to the jaws 12 and 14 is by having the pivot pins 20, 22 and 26 pass through bores and engage the opposite pair of links.

The assembly also includes an operating arm assembly generally designated 30 which operating arm assembly includes a pair of arms 32 and 34 having their forward ends pivotally connected to the lower jaw member 12 adjacent the forward end 36 thereof via a pivot pin or screw 38. The extended rearward end of the pair of arms 32 and 34 are cross-connected by a hand engaging plate 40. Further, each of the arms 32 and 34 is connected to the upper jaw member 14 by a pair of links **42*a* for one side and 42*b* for the opposite side. Links 42*a* and 42*b* are pin connected as at 44 to their respective arms 32 and 34 rearward of the forward pivots 38 but forwardly of the opening 28 for pivot pin 26 for link members 24.**

The opposite ends of links **42*a* and 42*b* are pin connected as at 48 to their respective sides of the upper jaw member 14, with the points 48 of pivotal connection being in the same transverse plane as pivot pin 22 and forwardly of the pivotal connections 44 between the links and the arms 32 and 34.**

It will be noted that extension 12′ of jaw member 12 extends rearwardly to the rearward edge of plate 40 to provide stability to the assembly when downward pressure is applied to the plate to squeeze a tube.

Preferably the assembly also includes means generally designated 50 for retaining the collapsible tube such as illustrated at 52 between the jaws 12 and 14 of the device. The retaining means 50 comprises a leaf spring 54 which is secured to the top surface of the upper jaw member 14 by retaining screw 56 and the assembly includes a pair of retaining spikes 58 secured such as by welding to the undersurface of the leaf spring 54.

Figure 2:
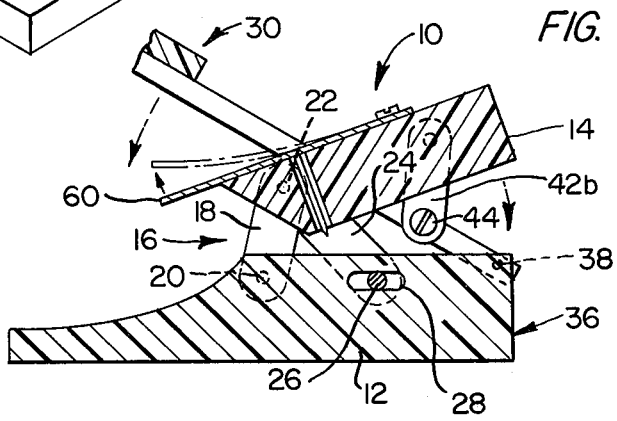
FIG. 2 is a section through the structure shown in FIG. 1.
Figure 3:
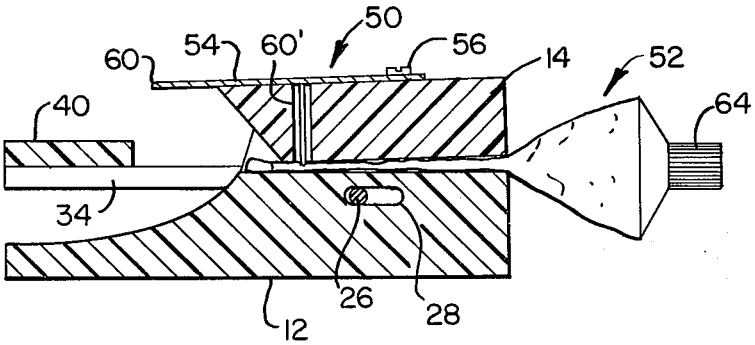
FIG. 3 is a view like FIG. 2 showing the tube squeezing device with the jaw members in the closed position and a tube in the operative position.
Figure 4:
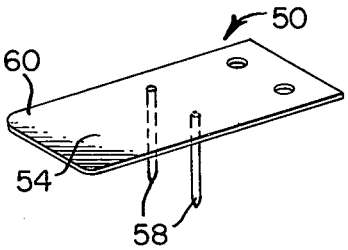
FIG. 4 is a perspective view of the tube anchoring mechanism.

The retaining spikes 58 pass through bores 60 in the jaw member 14 and are of a length such that the pointed tips thereof extend beyond the thickness of the jaw member 14 so that, when the jaw member is in the tube squeezing position as illustrated in FIG. 3 of the drawing, the tube is held thereby. As the contents of the tube are expelled, the rearward end 60 of the leaf spring 54 is lifted upwardly as illustrated in FIG. 2 withdrawing the pointed retaining spikes 58 from the wall of the tube so that the tube may be shoved toward the rear wall of the device to position the remaining portion of the tube within the confines of the pair of jaws 12 and 14.

In operation of the form of the invention shown in FIGS. 1–4, the handle 40 is lifted upwardly to the position shown in FIGS. 1 and 2 creating a gap between the jaws 12 and 14 and a collapsible tube such as tube 52 is inserted between the jaws with the outlet end 64 adjacent the foward end 36 of the device. At the same time, leaf spring 54 is lifted upwardly and then released to grip the collapsible tube 52. Then, with the cap removed from the tube, downward force on the handle 40 causes the two jaws to be moved toward each other closing the gap therebetween and forcing the contents from the outlet end 64 of the collapsible tube 52.

It will be noted in view of the slotted opening 28 as the handle 40 is lifted upwardly the jaw 14 moves first generally vertically away from the jaw 12 and at the end of its movement it moves slightly forwardly. Downward motion of the handle 40 first causes the jaw 14 to move toward the jaw 12 and, when contact if made between both of the jaws and the collapsible tube 52, there is a slight rearward motion of the jaw 14 in view of the limited sliding motion of the pivot shaft 26 in the slot 28. This rearward motion assist in retaining the collapsible tube between the jaws rather than forcing the tube outwardly against the holding force of the pair of depending grippers or spikes 58.

The apparatus hereinbefore described may be constructed of metal, plastic, wood, ceramic, or any combination thereof as long as the material of construction has sufficient strength to perform its intended function and experiments have shown that the device is equally satisfactory when squeezing the contents from plastic or metal foil collapsible tubes.

Figure 5:
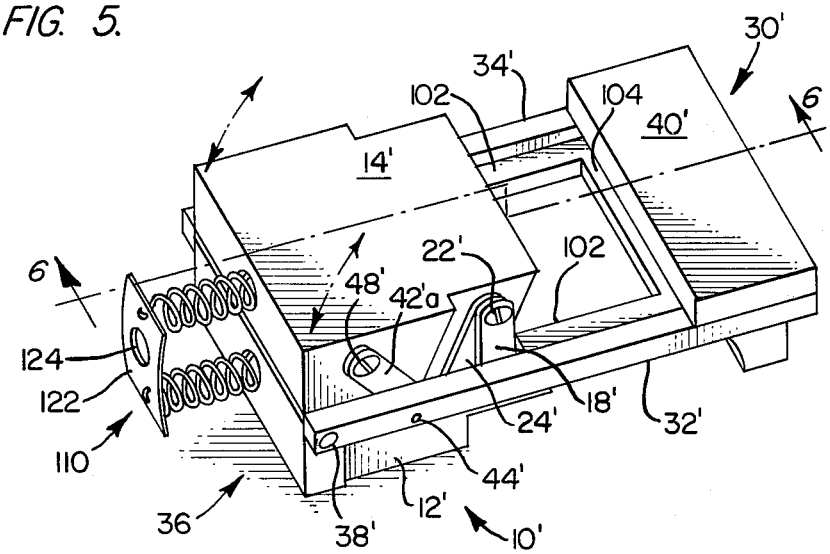
FIG. 5 is a perspective view of a modified form of the present invention.
Figure 6:
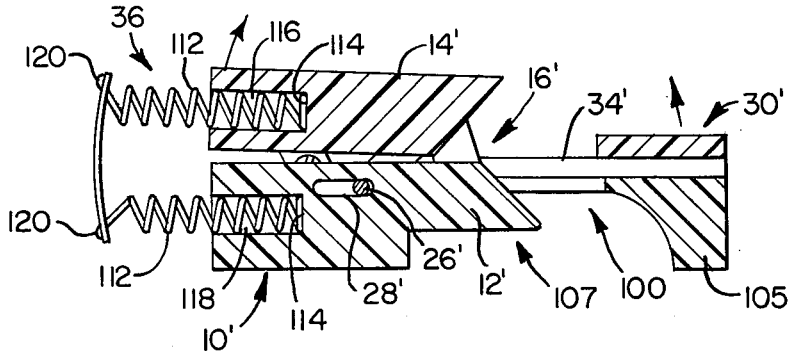
FIG. 6 is a section on line 6-6 of FIG. 5.
Figure 7:
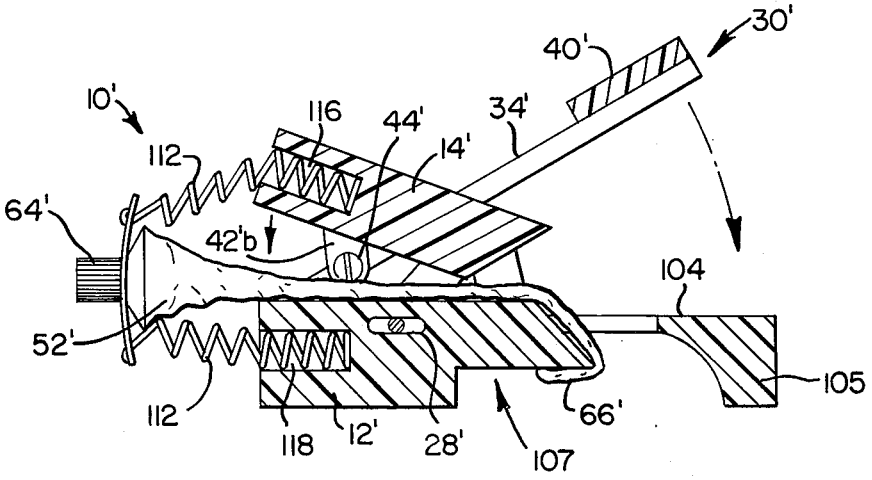
FIG. 7 is a view like FIG. 6 with the jaws in the open position and a tube in the operative position.

Now referring to FIGS. 5, 6 and 7, a modified form of the present invention is shown wherein like parts are provided with primed reference characters corresponding to those employed in the description of the first form of the invention.

In FIGS. 5–7, 10′ generally designates a second form of the improved tube squeezing device and includes a first jaw member 12′ and a second jaw member 14′. The pair of jaw members 12′ and 14′ are pivotally connected adjacent the rearward end 16′ thereof by two pairs of links with a pair on each side of the jaw members.

The pairs of links comprise a first link 18′ which is pivoted via pivot pin or screw to the lower jaw member 12′ and via pivot pin or screw 22′ to the upper jaw member 14′. The other link of each pair of links designated 24′ is pivotally connected to the upper jaw member 14′ by the pivot pin 22′ which as previously described also connects the first link 18′ of the pair of links to the upper jaw member 14′. The other end of the link 24′ is pivotally connected to the jaw member 14′ by a pin 26′ which pin engages an elongated slot 28′ in the jaw member 12′ whereby the link 24′ has limited sliding movement relative the jaw 12′.

A convenient method of attaching the two pairs of links 18′ and 24′ to the jaws 12′ and 14′ is by having the pivot pins pass through bores and engage the opposite pair of links.

The assembly also includes an operating arm assembly generally designated 30′ which operating arm assembly includes a pair of arms 32′ and 34′ having their forward ends pivotally connected to the lower jaw member 12′ adjacent the forward end 36′ thereof via a pivot pin or screw 38′. The extended rearward end of the pair of arms 32′ and 34′ are cross-connected by a hand engaging plate 40′. Further, each of the arms 32′ and 34′ is connected to the upper jaw member 14′ by a pair of links **42*a*′ for one side and 42*b*′ for the opposite side. Links 42*a*′ and 42*b*′ are pin connected as at 44′ to their respective arms 32′ and 34′ rearward of the forward pivots 38′ but forwardly of the opening 28′ for pivot pin 26′ for link members 24′. The opposite end of links 42*a*′ and 42*b*′ are pin connected as at 48′ to their respective side of the upper jaw member 14′, with the pivot point 48′ being in the same transverse plane as pivot pin 22′ and forwardly of the pivotal connections 44′ between the links and the arms 32′ or 34′.**

The operating handle assembly 30′ functions in coordination with operating assembly generally designated 100 which includes a pair of arms 102 extending rearwardly from the lower jaw member 12′ and a cross plate 104. The cross plate 104 has a pair of depending legs 105 of a length such that the device is stable when positioned on a flat surface and is in the position shown in FIGS. 6 and 7. In order to operate the device, a squeezing force is exerted between cross member 40′ and cross member 104. In order to provide space for the rearward end of the empty portion of the collapsible tube 52′ as most clearly illustrated in FIGS. 7 of the drawing, the rearward portion 107 of jaw portion 12′ is cut away to provide sufficient space between the jaw member 12′ and the cross member 104 to receive the end 66′ of the tube 52′.

In this form of the invention, a modified form of tube holding, centering and feeding mechanism is provided and generally designated 110. The assembly includes a pair of helical springs 112, ends 114 of which are received in longitudinal bores 116 in jaw member 14′ and 118 in jaw member 12′. The inward ends 114 of each of the springs 112 are secured at the ends of the bores 116 and 118 respectively by, for example, a suitable adhesive or cement. The opposite ends 120 of each of the springs 112 are secured to a cross plate 122 provided with a central bore 124 therein. The central bore 124 receives the neck portion 64′ of the collapsible tube 52′ and urges the tube toward the rear end of the device and at the same time maintains the tube 52′ in generally central location between the jaws 12′ and 14′.

While in this form of the invention the feeding and centering mechanism 110 includes helical springs 112, it is apparent that elastomeric members may be substituted therefor.

Either form of the illustrated embodiments of the present invention may be suitably mounted to a vertical wall structure with the tube outlet end being positioned in the upwardly, downwardly or sidewardly direction or the device may be simply laid or attached on a horizontal supporting surface.

It will also be appreciated that the pairs of links 18–24 and 18′–24′ could be formed as a single triangular link, however the amount of rearward and forward sliding motion would be restricted compared to that available when pairs of links are used.

From the foregoing description, it will be recognized by those skilled in the art that various modifications of the improved collapsible tube squeezing device may be devised without departing from the scope of the appended claims.

I claim:

1. A collapsible tube squeezing device comprising a pair of jaw members, means mounting said jaw member to receive a collapsible tube therebetween, said mounting means including:

a. a first pair of links pivotally connecting opposite sides of one end of each jaw member with the longitudinal axes of the pair of links being generally normal to planes of the jaw members, and b. a second pair of links pivotally connected at one end to the pivotal connection between the first pair of links and one of the jaw members and connected at the other end to the other jaw member for limited sliding motion relative to said other jaw member in a plane parallel to the plane of the said other jaw member.

2. The invention defined in claim 1 including operating lever means pivotally connected to the pair of jaw members.

3. The invention defined in claim 2 including a cooperating operating lever extending rearwardly from the other of said jaw members.

4. The invention defined in claim 2 including collapsible tube retaining means associated with one of said jaw members.

5. The invention defined in claim 2 including collapsible tube retaining means associated with each of said jaw members.

6. The invention defined in claim 5 wherein said collapsible tube retaining means includes a pair of helical springs with one of said pair received in each of the jaw members and a connecting plate secured to the extended end of each spring member with a bore adapted to receive the outlet nozzle of a collapsible tube therein.

* * * * *